US005353996A

United States Patent [19]

Gallacher et al.

[11] Patent Number: 5,353,996

[45] Date of Patent: Oct. 11, 1994

[54] SOOTBLOWER FRAME AND DRIVE ASSEMBLY

[75] Inventors: William S. Gallacher, Walla Walla; Steven Ginter, Pasco; Steven Pavel, Kennewick, all of Wash.

[73] Assignee: Boise Cascade Corporation, Boise, Id.

[21] Appl. No.: 19,747

[22] Filed: Feb. 18, 1993

[51] Int. Cl.[5] ..... F23J 3/02

[52] U.S. Cl. ..... 239/752; 239/750; 239/DIG. 13; 122/379

[58] Field of Search ..... 239/750, 751, 752, DIG. 13, 239/227, 753; 15/316.1; 122/379, 382, 390, 391, 392

[56] References Cited

U.S. PATENT DOCUMENTS

| | | | |
|---|---|---|---|
| 2,082,330 | 6/1937 | Frede et al. | 239/227 |
| 3,377,026 | 4/1968 | De Mart et al. | 239/752 |
| 3,736,909 | 6/1973 | Marangoni et al. | 239/753 X |
| 4,218,016 | 8/1980 | Freund | 239/DIG. 13 |
| 4,273,076 | 6/1981 | Lahoda et al. | 239/750 X |
| 4,276,856 | 7/1981 | Dent et al. | 239/750 X |
| 4,437,201 | 3/1984 | Zalewski | 15/316 |
| 4,803,959 | 2/1989 | Sherrick et al. | 122/279 |
| 4,844,021 | 7/1989 | Stoss | 15/316.1 X |
| 5,037,672 | 8/1991 | Daussen et al. | 239/227 X |
| 5,040,262 | 8/1991 | Albers et al. | 15/316 |
| 5,063,632 | 11/1991 | Clark et al. | 15/316 |
| 5,097,564 | 3/1992 | Billings | 15/316 |

OTHER PUBLICATIONS

Diamond Power Design Drawings 502600-351C, 502600-352C, dated Apr. 22, 1982 (Exhibit A).

Diamond Power Design Drawings entitled "Blower Assembly .R.H. IK-525 Fabricated Beam," dated Nov. 11, 1987 (3 pages) (Exhibit B).

Diamond Power Design Drawings entitled "Blower Assembly .R.H. IK-525 Fabricated Beam," dated Jan. 20, 1988 (3 pages) (Exhibit C).

Diamond Power Design Drawings entitled "Blower Assembly .R.H. & L.H. IK-525 Fabricated Beam," dated Mar. 26, 1988 (4 pages, and 5 sheets of photographs represented to be circa 1988) (Exhibit D).

Diamond Power Design Drawings entitled "Blower Assy. IK-545 EMD R.H. /L.H. Fabricated Beam," dated Mar. 21, 1988 (4 pages) (Exhibit E).

Memorandum dated Nov. 18, 1992, from Jesse Johnston to Raj Patel entitled "Synopsis of Fabricated Open Type Beam Assemblies," represented to describe some of the beam assemblies disclosed herein in Exhibits A-E (Exhibit F).

"New Replacement Parts Source for Diamond Power Soot Blowers" brochure, by Copes-Vulcan, Inc., Bulletin No. 1142-A, circa Jan. 1992, pp. 1-6.

"Soot Blowers for the Pulp and Paper Industry" brochure, by Copes-Vulcan, Inc., Bulletin No. 1139, Jan. 1990, pp. 1-6.

"Model 'RS' Recovery Service Retractable Sootblower" brochure, by Bergemann USA, Inc., circa Jun. 1990.

*Primary Examiner*—Andres Kashnikow
*Assistant Examiner*—Lesley D. Morris
*Attorney, Agent, or Firm*—Klarquist Sparkman Campbell Leigh & Whinston

[57] ABSTRACT

A sootblower frame and drive assembly has a pair of parallel spaced-apart longitudinal beams interconnected by plurality of rigid transverse frame members. Racks gears are mounted to the inside of the beams for carrying a drive carriage that drives a lance tube. The frame is rigid and resistant to torsional flex and has open opposite sides to increase air circulation around the sootblower.

17 Claims, 3 Drawing Sheets

SOOTBLOWER FRAME AND DRIVE ASSEMBLY

TECHNICAL FIELD

This invention relates to sootblowers used to remove soot deposits from boilers, and more particularly to sootblower frames and drive assemblies.

BACKGROUND INFORMATION

Combustion by-products such as soot, ash and slag often accumulate on the interior of industrial boilers, for example on the boiler tube surfaces. These accumulations dramatically decrease the efficiency of the heat transfer to the boiler tubes. Sootblowers are commonly used to remove the accumulated soot to increase efficiency.

A sootblower usually has a long, steam-carrying lance mounted on parallel tracks that are in turn mounted to an elongated inverted U-shaped sheet-metal housing on the exterior of the boiler. A gear-driven carriage moves the lance tube forward toward the boiler, injecting it into the interior of the boiler through an injection port in the side of the boiler.

After a nozzle at the forward end of the lance tube is injected into the boiler interior, steam is discharged through the nozzle against the interior surfaces of the boiler, blasting soot, ash and slag off the surfaces. The gear drive and carriage then reverse direction to retract the lance from the boiler. In addition to the horizontal travel of the lance along the tracks, the lance is rotated about its longitudinal axis as it travels into and out of the boiler.

Most industrial sootblowers are used in extremely harsh environmental conditions. The interior temperature of the boiler is typically very high, while the exterior temperature is much lower. The lance tube is therefore exposed to wide variations in temperature as it is injected into and removed from the boiler. Further, some combustion by-products are highly corrosive, and may escape from the boiler through the lance injection ports.

Conventional sootblowers include a pair of parallel tracks mounted to the interior of an inverted U-shaped sheet metal housing to carry a gear-driven carriage that drives the lance tube into and out of the boiler through the lance injection-port. The housing serves as the support structure for the tracks and carriage of the sootblower assembly. In some cases, the housing is designed to completely cover the lance tube throughout its length from the boiler outward. The housing is closed on three sides and therefore acts as a hood; it is open on the underside, but closed on the top and sides.

The sootblower assembly is mounted above ground. In conventional sootblower assemblies, the rearward end of the housing is often supported above the floor with either ceiling hangers or a floor support. The forward end of the housing is attached to the boiler. Conventional sootblowers usually have no intermediate support members between the boiler wall and the rearward end of the assembly.

Due to the weight of the gear-driven carriage and lance tube, the sheet metal housing has a tendency to flare as the lance tube moves within the housing, causing misalignment of the normally parallel tracks.

Additionally, heat tends to accumulate within the hoodlike housing, and it is difficult to dissipate. Similarly, the corrosive combustion by-products escaping from the boiler's combustion chamber through the lance injection port tend to accumulate within the housing.

The combination of heat and corrosive by-products accumulation in the housing, and the difficulty in dissipating either therefrom, often lead to warping and corrosion of the entire sootblower. Warping leads to misalignment of the tracks, causing excessive wear on the drive system and even failure of the carriage and gear drive assembly. Corrosion weakens the sootblower components, contributing to misalignment problems and failure of steam pipes and the like.

As a result, conventional sootblowers require frequent inspection and maintenance to remove rust, replace leaking pipes, and repair misaligned tracks and worn drive system components. Nevertheless, sootblower inspection and maintenance can be unpleasant and dangerous, and therefore neglected, because of the danger from exposure to heat and corrosive compounds.

Accordingly, there is a need for a sootblower assembly with a frame construction that eliminates the foregoing problems including warping and misalignment problems caused by weight, heat and corrosive conditions, thereby allowing easier and safer maintenance. These are the primary objectives of the present invention.

SUMMARY OF THE INVENTION

The invention is a sootblower frame and drive assembly having an open but rigid frame. The rigid frame resists bending and torsional flexing, and therefore maintains the desired parallel relationship of the drive tracks. Because the top and bottom of the frame are open, heat and corrosive compounds dissipate easily from around the sootblower lance tube, and do not accumulate.

The sootblower frame comprises two transversely spaced-apart parallel beams. End plates interconnect the ends of the beams to form a rigid rectangular frame. Additional cross members add further structural support, strength and rigidity, both torsionally and longitudinally, to the frame.

A drive track is mounted to each of the parallel beams. A drive assembly comprising a carriage assembly mounting a reversible drive motor, is connected to the lance tube. The carriage assembly is driven back and forth along the tracks to inject the lance tube into the boiler and withdraw it therefrom. The carriage assembly is supported by the rigid frame such that the sootblower components, including the tracks, drive assembly and lance tube, will maintain their desired positions, orientations and relationships in use.

DESCRIPTION OF THE PREFERRED EMBODIMENTS

Figure 1:
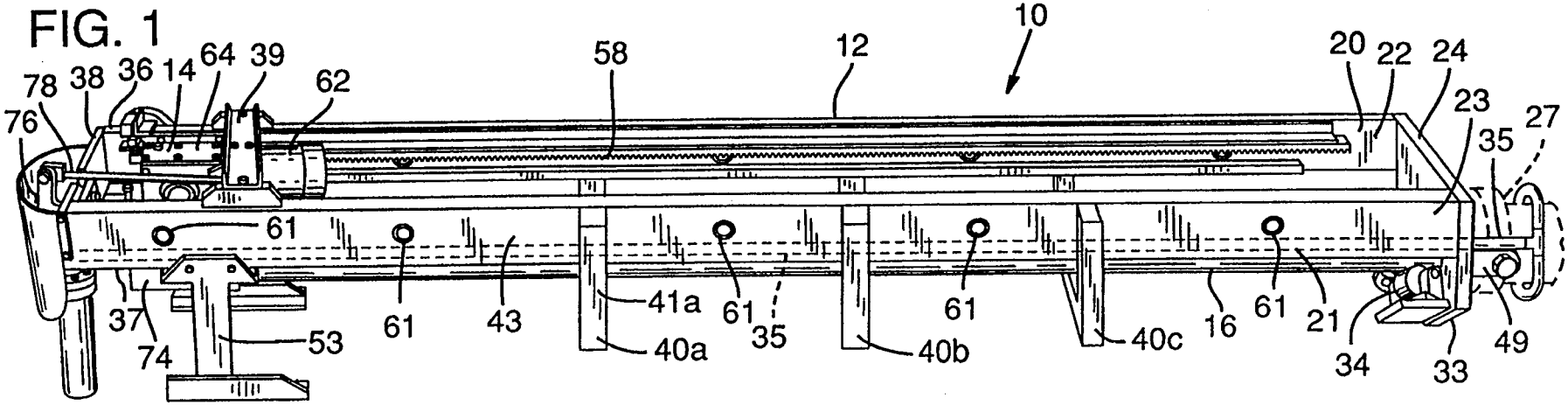
FIG. 1 is a perspective view of one embodiment of the sootblower support frame and drive assembly of the present invention.

With reference to FIGS. 1–4, a sootblower assembly 10 comprises an elongated horizontal rectangular support frame 12 for supporting a conventional movable drive carriage 14. The forward end of sootblower assembly 10 is mounted in close proximity to a boiler 18. A conventional steam-fed lance tube 16 is rotatably mounted to carriage 14 in the usual manner. As described below, upon actuation of the sootblower assembly, lance tube 16 is injected into and retracted from boiler 18 (partially shown in FIG. 2), and is simultaneously rotated about its longitudinal axis in a well-known manner. Steam is blown out of a nozzle (not shown) in the forward end of lance tube 16 as it reciprocates in the boiler, blasting soot and ash from the boiler tube surfaces.

Frame 12 includes two parallel spaced-apart transversely opposed rigid steel box beams 20, 21. A primary feature of the present invention is the rigidity of the frame structure. Therefore, the beams are designed to be torsionally, laterally and longitudinally rigid; that is, to resist torsion and bending.

In the preferred embodiment, beams 20, 21 are rectangular in cross section, and are hollow. Standard thick-walled steel beams are sufficient in this regard. However, the beams can also comprise other conventional shapes having a suitable resistance to bending and torsion such as I-beams and channels.

A front end plate or base plate 24 is connected to the forward ends 22, 23 of beams 20, 21, such as by welding, to interconnect the beams. End plate 24 extends transversely between beams 20 and 21 in a direction substantially perpendicular to the longitudinal axis of the beams.

Front end plate 24 includes an off-center opening 26 defining part of a passageway 28 (shown in dashed lines in FIG. 2) that is aligned with an injection port (not shown) defined by a wall box or boiler extension 27. Lance tube 16 is injected into and retracted from the boiler through opening 26 and passageway 28. A lower edge 30 of front end plate 24 has two opposite chamfered portions 32, 33 (best shown in FIGS. 3 and 4) to which guide rolls 34 are attached. Guide rolls 34 support and guide lance tube 16 during its reciprocative movement into and out of boiler 18.

Rear ends 36, 37 of beams 20, 21, respectively, are welded to a back end plate 38 that extends transversely between the beams in a direction substantially perpendicular to the longitudinal axis of the beams to interconnect them.

Both front end plate 24 and rear end plate 38 are preferably solid, thick metal plates that will withstand warping under repeated wide fluctuations in temperature, and harsh environmental conditions.

The combination of end plates 24 and 38, and beams 20 and 21, constructed as described, forms a very rigid box shaped frame having open opposite sides, in this case, an open top and bottom. It is to be understood that more than two transverse plates can be used to interconnect beams 20, 21 for even greater rigidity of the frame.

To further improve the frame's resistance to torsional and bending forces longitudinally spaced-apart transverse U-shaped struts or cross frame members 40 (designated 40*a*, 40*b* and 40*c* in FIG. 1) are welded to outside walls 42, 43 of beams 20, 21 at points between end plates 24 and 38 to interconnect beams 20, 21. Each of the struts 40 is identical but the struts can also be of different shapes and materials. Thus, referring to strut 40*a* in FIG. 1, opposite downwardly extending legs 41*a* and 45*a* are connected, such as by welding, to outer beam walls 42, 43, respectively, and a cross member 47*a* connects the legs 41*a* and 45*a*. Struts 40 are generally equally spaced apart between the end plates.

A plurality of spaced-apart tubes 61 extend transversely through the hollow beams 20, 21. Tubes 61 extend from outer walls 42, 43 through beams 20, 21 to inside walls 54, 56, respectively. The tubes are mounted, such as by welding, to the beams between struts 40 to further increase the rigidity of beams 20, 21.

A removable cross bar 39 extends over frame 12 between beams 20, 21 at the rearward ends 36, 37 to provide support for a pivot block (not shown) operatively connected to a linkage 78. Cross bar 39 also adds structural rigidity to the frame.

Figure 2:
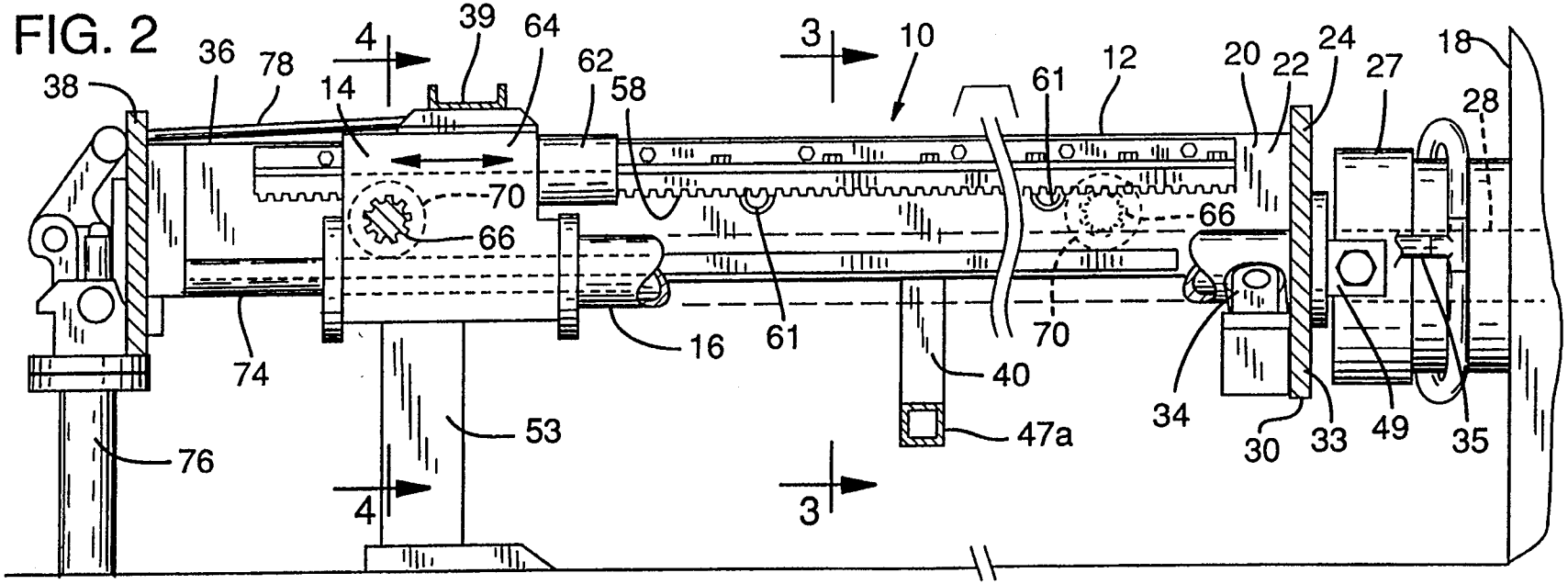
FIG. 2 is an enlarged and foreshortened elevational side view of the mechanism of FIG. 1, with one side of the support frame removed and a portion of the lance tube broken away for clarity.
Figure 3:
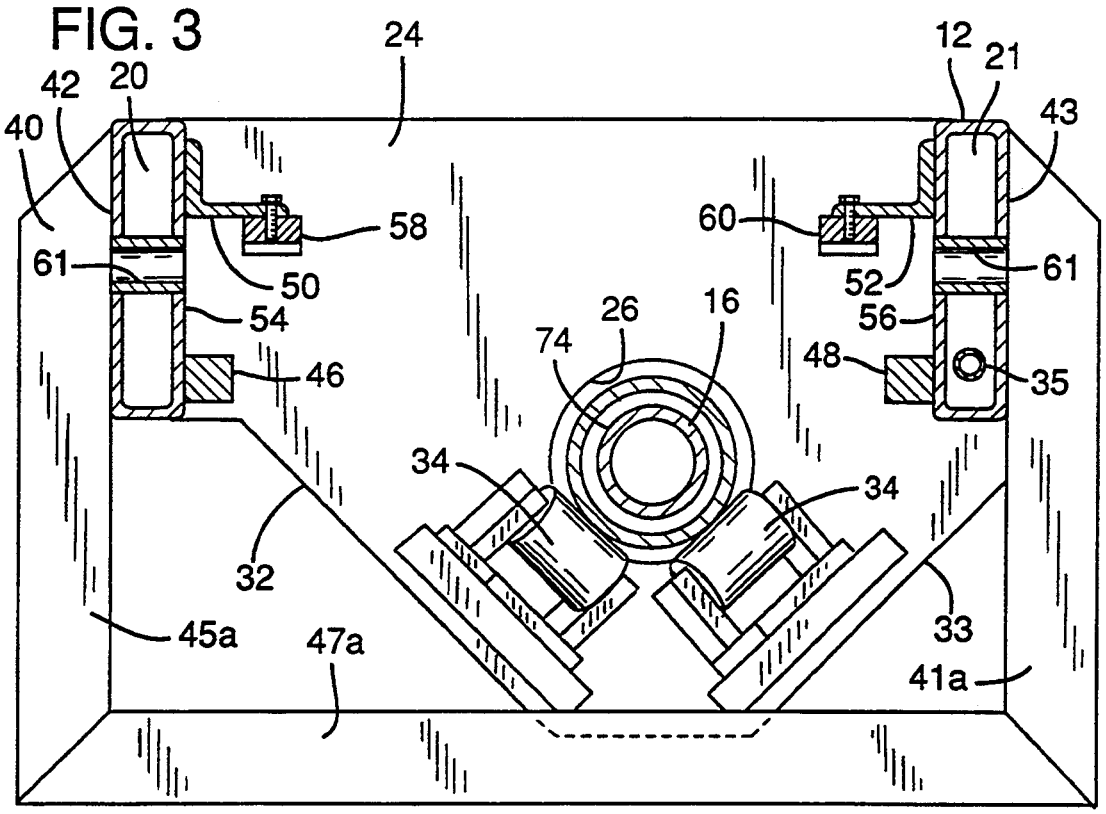
FIG. 3 is a cross-sectional view, taken along the line 3—3 Of FIG. 2.
Figure 4:
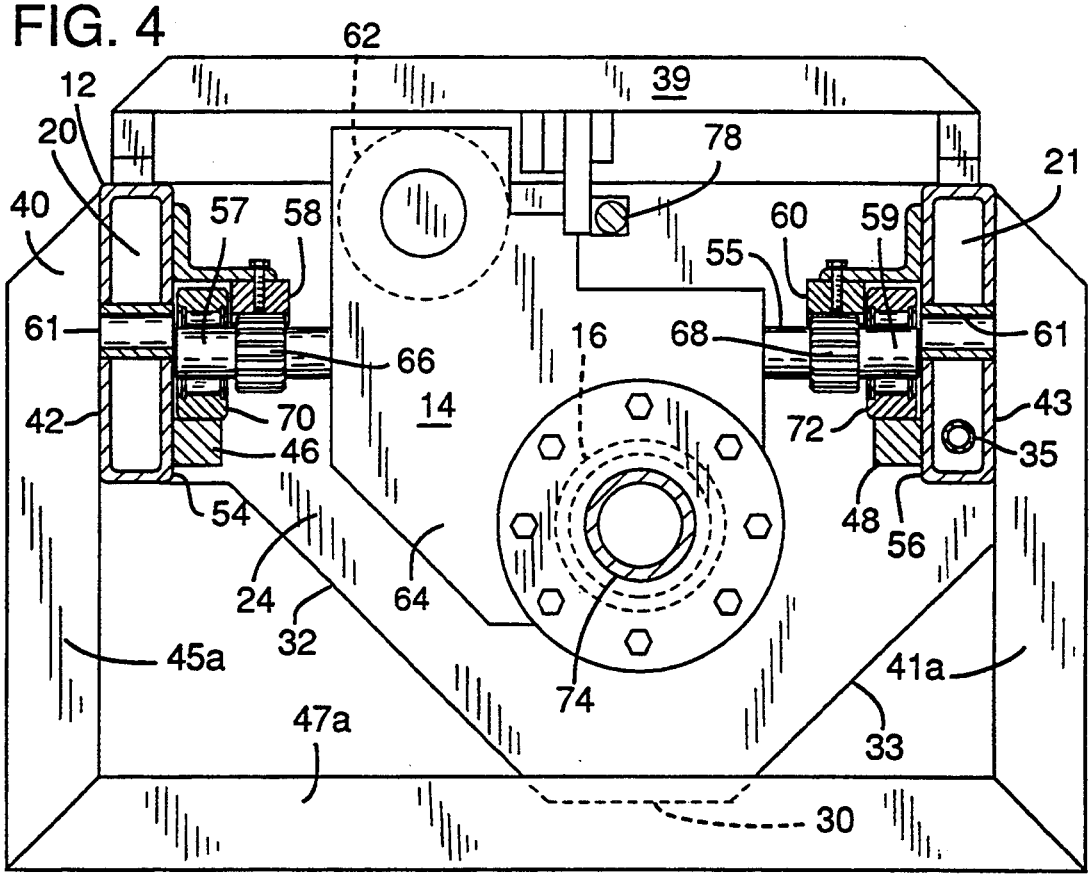
FIG. 4 is a cross-sectional view, taken along the line 4—4 of FIG. 2.

Frame 12 is further supported at its front end by two lugs (only one lug 49 is shown in FIGS. 1 and 2) attached to front plate 24. The lugs are connected to boiler extension 27. A pair of sturdy support legs 51, 53 support rearward end of frame 12. Support legs 51, 53 may be secured to the floor.

A boiler extension steam feed tube 35 extends from back end plate 38 inside beam 21 through front end plate 24. Steam feed tube 35 is connected to the inside of boiler extension 27 through two openings (not shown) so that steam can remove ash from the inside of boiler extension 27. The positioning of the hot steam feed tube 35 inside beam 21 prevents a person maintaining the sootblower from being burned on the hot tube.

Carriage 14 is positioned transversely between beams 20, 21, and is horizontally guided along two pairs of parallel tracks mounted on opposite sides of frame 12, including lower tracks 46 and 48, and upper tracks 50, 52. Carriage 14 includes a drive shaft 55 extending in opposite direction from carriage 14 toward inside walls 54, 56 of beams 20, 21, respectively. Wheels 70, 72 of carriage 14 are rotatably supported by lower tracks 46, 48 for travel therealong.

Tracks 46, 48 are made from an elongated square support rod connected to opposite inside walls 54, 56 of beams 20, 21 by threaded fasteners or welding. Upper tracks 50, 52 are made from angle iron stock which is also connected to beams 20, 21 by threaded fasteners or welding. Rack gears 58, 60 are rigidly connected to upper tracks 50, 52, respectively, and are provided to enable longitudinal driving movement of carriage 14.

Carriage 14 drives lance tube 16, rotationally attached thereto, into and out of the boiler and includes a drive motor 62 and a gear box 64 for this purpose. Drive shaft 55 of carriage 14 drives a pair of drive pinion gears 66, 68 adjacent to opposite ends 57, 59 of drive shaft 55. Pinion gears 66, 68 mesh with rack gears 58, 60, respectively so that the driven pinion gears drive the carriage 14 and connected lance tube 16 along the pairs of tracks. Wheels 70, 72 engage tracks 46, 48 to support drive carriage 14 in its reciprocative travel.

A steam feed tube 74 is attached at one end to rear end frame plate 38 and conducts steam into lance tube 16 controlled through the action of a poppet valve 76. Poppet valve 76 is actuated through linkage 78 which is engaged by carriage 14 to begin steam discharge upon extension of lance tube 16 into boiler 18, and cut off steam flow when the lance tube and carriage return to their idle retracted position.

Lance tube 16 over-fits feed tube 74. A fluid seal between them is provided by a packing (not shown) so that steam is conducted into lance tube 16 for discharge from the nozzle.

Frame 12 is resistant to torsional flex and bending even under load conditions such as when carriage 14 drives lance tube 16 back and forth along the tracks.

Another important feature of the present invention is the open top and bottom of the frame assembly, which allows air to freely circulate through the frame between the beams and end plates. It is to be understood that frame 12 may be open at its opposite sides instead of top and bottom, with the beams being provided top and bottom, although air circulation may be reduced somewhat.

The open construction reduces excessive corrosion. In conventional sheet metal soot blower housings, corrosive compounds tend to collect under the sootblower housing, causing damage to the housing and moving parts therein.

Additionally, the free circulation of air increases the dissipation of heat. Over time, un-dissipated heat tends to cause warping and misalignment of the parallel tracks. Misalignment of the tracks, in turn, leads to excessive wear on the motor 62 and pinion gears 66, 68 or even failure of carriage 14, gear box 64 and steam pipes. Thus, the open frame of the present invention helps maintain the critical parallel orientation of the tracks.

As a result, a soot blower having the frame and drive assembly arrangement of the present invention requires less maintenance to remove rust and replace misaligned tracks and worn gears. In addition, persons conducting the repair are less exposed to hot equipment and dangerous gases compared to conventional soot blowers using a hood-like housing inaccessible except from the bottom.

A protective wire cage (not shown) may be attached around the sootblower frame to shield workers from hot surfaces. The wire cage does not inhibit free circulation of air around the sootblower.

In operation, carriage 14 moves forward from a position adjacent back plate 38 (the retracted or idle position as shown in FIGS. 1 and 2) to extend lance tube 16 through opening 26 and the injection port of the boiler. When the nozzle is inside the boiler, steam is injected through feed tube 74 and lance tube 16 and discharged through the nozzle. Lance tube 16 rotates about is longitudinal axis as it travels from the retracted position to the extended position.

After extending the lance tube into the boiler, carriage 14 then reverses direction to retract lance tube 16 from the boiler while the lance tube rotates about its axis and steam is discharged from the nozzle. Before the nozzle exits the injection port, poppet valve 76 shuts off the steam supply so that lance tube 16 is withdrawn from the boiler without discharging steam.

As carriage 14 and lance tube 16 travel retracted and extended positions, frame 12 is exposed to load changes and large fluctuations in temperature. However, because of the rigid, box-like but open frame construction, the beams maintain their parallel relationship to maintain the pairs of tracks in mutually parallel relationship to minimize drive carriage and gear wear.

Figure 5:
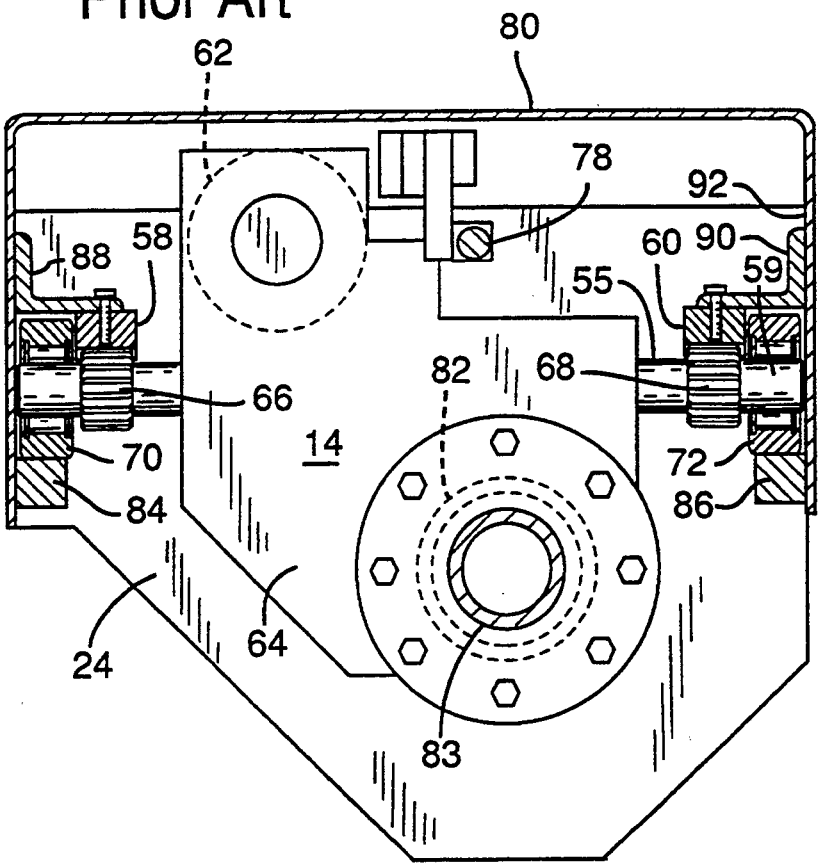
FIG. 5 Prior Art
FIG. 5 is a cross-sectional view similar to the view of FIG. 3, of a prior art sootblower sheet-metal housing.

A typical prior art sootblower frame is shown in FIG. 5. The frame assembly in the prior art apparatus consists of an inverted generally U-shaped sheet metal housing 80 that covers the top and both sides of the sootblower drive assembly to effectively enclose a lance tube 82, a feed tube 83 and the associated carriage and drive system. Lower tracks 84, 86, and upper tracks 88, 90 are attached directly to an inside wall 92 of the housing 80. Sootblowers utilizing this or similar construction have all of the problems previously described, resulting from flare, torsional flexing, particularly about the longitudinal axis of the lance tube, and accumulation of heat and corrosive compounds under the hood-like housing.

While the present invention has been described with reference to preferred embodiments, it is to be understood that certain substitutions and alterations may be made thereto without departing from the spirit and scope of the invention as set forth in the appended claims.

We claim:

1. A sootblower frame and drive assembly, comprising:

a pair of parallel tracks;

frame means mounting and maintaining the tracks in parallel alignment, the frame means comprising a pair of side-by-side transversely spaced-apart rigid parallel beams coextensive in length, and the frame means being open at its top and bottom between the beams substantially throughout the length of the frame means, one of the open top and bottom being substantially unobstructed throughout its length, and one track of the pair being affixed to an inside face of each beam;

a carriage mounted on the parallel tracks for movement between an extended and retracted position between the beams; and a lance tube rotatably connected to the carriage for rotation about the longitudinal axis of the lance tube as the lance tube moves between the extended and retracted position the lance tube operably connected to the carriage so that movement of the carriage between its extended and retracted position moves the lance tube between its extended and retracted position.

2. The sootblower frame and drive assembly according to claim 1, wherein:

at least two longitudinally spaced-apart cross frame members interconnect the beams.

3. The sootblower frame and drive assembly according to claim 2, wherein the beams have opposite ends, and the cross frame members include a pair of base plates interconnecting the beams at their opposite ends and at least one intermediate cross frame member spaced from the opposite ends.

4. The sootblower frame and drive assembly according to claim 1, wherein the beams are hollow box beams.

5. A frame for mounting a sootblower lance and drive carriage assembly having a rack-and-pinion drive, the frame comprising:

a pair of transversely spaced apart longitudinally extending and coextensive parallel upright hollow box beams interconnected at their forward and rearward end portions by rigid end members to define a rigid rectangular frame open at its top and bottom between the end members;

a rack gear and track assembly affixed to the inside face of each box beam for mounting a pinion gear and wheel portion of the lance and drive carriage assembly, the rack gear and track assembly of one box beam extending parallel to the rack gear and track assembly of the other box beam.

6. The frame of claim 5 in which the box beams are interconnected at intervals along their lengths between the end members by U-shaped cross members;

each cross member including a pair of upright frame members one affixed to the outside face of each box beam and extending beyond one of the top and bottom extremities of the box beams, and a cross frame member interconnecting the distal ends of the upright frame members and spaced beyond the one extremity of the box beams.

7. The frame of claim 5 wherein the upright frame members of each cross member extend above the tops of the box beams and the cross frame member is spaced above the tops of the box beams.

8. The frame of claim 6 wherein the upright frame members of each cross member extend below the bottoms of the box beams and the cross frame member is spaced below the bottoms of the box beams.

9. The frame of claim 5 in which the box beams are interconnected at intervals along their lengths between the end members by U-shaped cross members each including a cross frame member spaced from the tops and bottoms of the beams to provide free access to the space between the beams from at least one of the top and bottom openings of the frame and at least limited access from the other of the top and bottom openings of the frame.

10. The frame of claim 9 in which each box beam includes spaced apart inner and outer upright walls interconnected at their upper and lower ends by top and bottom walls, and reinforcing members within each beam interconnecting the inner and outer walls at positions spaced from the top and bottom walls and at intervals along the lengths of the box beams.

11. The sootblower frame and drive assembly according to claim 5, wherein the rectangular support frame is rigid and resistant to torsional flex along the longitudinal axis of the frame, resistantto bending stresses, resistant to beam misalignment, and resistant to warpage under high temperature conditions and temperature extremes, such that said rack gears remain substantially parallel to one another when said carriage is driven therealong.

12. The frame of claim 5 in which each box beam includes:

an inner upright wall, and an outer upright wall spaced from the inner upright wall, the inner and outer upright walls being interconnected at their upper and lower ends by top and bottom walls, and reinforcing members within each beam interconnecting the inner and outer walls between the top and bottom walls at intervals along the length of the beam.

13. The frame of claim 5 in which each box beam has a greater depth than width.

14. A sootblower frame and drive assembly comprising:

a pair of upright transversely spaced apart longitudinally coextensive parallel beams, each including a greater depth than width, each having at least one upright sidewall interconnecting top and bottom walls;

Rigid end frame members interconnecting the beams at opposite end portions thereof to define a rigid rectangular frame with top and bottom openings into the space between the beams, at least one of the top and bottom openings being substantially unobstructed for easy access into the space throughout a major length o the frame between the end frame members;

a drive track affixed to the inner face of the upright wall of each beam for drivingly receiving a drive carriage for a lance tube of a sootblower, the drive track on each beam extending parallel to the drive track on the other beam.

15. The apparatus of claim 14 wherein the frame includes cross members interconnecting the parallel beams at intervals along the lengths of the beams between the end frame members, each cross member spanning the distance between the beams at a level spaced vertically from the top and bottom walls of the beams such that both the top and bottom openings into the space between the beams are substantially unobstructed between the end frame members for easy access into the space between beams and for optimum air circulation through and heat dissipation from the frame.

16. A frame for mounting a sootblower lance and drive carriage assembly having a rack-and-pinion drive, the frame comprising:

a pair of transversely spaced apart longitudinally extending and coextensive parallel upright beams interconnected at their forward and rearward end portions by rigid end frame members to define a rigid rectangular frame with top and bottom openings into a substantially unobstructed space within the frame defined by the beams and end frame members;

each beam including an upright wall joining perpendicular top and bottom walls, the upright wall having a greater depth than the width of either of the top and bottom walls;

a rack gear and track assembly affixed to the inner face of the upright wall of each beam for mounting a pinion gear and wheel portion of the lance and drive carriage assembly, the rack gear and track assembly of one beam extending parallel to the rack gear and track assembly of the other beam.

17. The frame of claim 16 wherein the beams are interconnected by cross frame members between and spaced from the end frame members and spaced from each other lengthwise of the frame, all of the cross frame members spanning the distance between beams adjacent to either the bottom walls or the top walls of the beams, but not both, so as to leave one of the top and bottom openings substantially unobstructed by the cross frame members.

* * * * *

UNITED STATES PATENT AND TRADEMARK OFFICE

CERTIFICATE OF CORRECTION

PATENT NO. : 5,353,996

DATED : October 11, 1994

INVENTOR(S) : Gallacher et al.

It is certified that error appears in the above-indentified patent and that said Letters Patent is hereby corrected as shown below:

Column 7, line 11, change "5" to --6--.

Column 7, line 38, after "frame," change "resistantto" to --resistant to--.

Signed and Sealed this

Nineteenth Day of March, 1996

Bruce Lehman

*Attest:*

BRUCE LEHMAN

*Attesting Officer*

*Commissioner of Patents and Trademarks*